United States Patent [19]

Wyman

[11] 4,115,045

[45] Sep. 19, 1978

[54] ROTARY MOTOR

[76] Inventor: James C. Wyman, 2002 Westridge Rd., Carlsbad, N. Mex. 88220

[21] Appl. No.: 790,859

[22] Filed: Apr. 26, 1977

Related U.S. Application Data

[63] Continuation of Ser. No. 419,284, Nov. 27, 1973, abandoned.

[51] Int. Cl.[2] ..... F01C 1/00; F01C 19/04; F01C 21/04

[52] U.S. Cl. ..... 418/97; 418/122; 418/248

[58] Field of Search ..... 418/221, 248, 249, 122, 418/97

[56] References Cited

U.S. PATENT DOCUMENTS

| | | | |
|---|---|---|---|
| 542,920 | 7/1895 | Berry | 418/221 |
| 594,924 | 12/1897 | Woodard | 418/221 |
| 610,497 | 9/1898 | Probst | 418/221 |
| 892,374 | 6/1908 | Hillyer | 418/248 |
| 992,582 | 5/1911 | Olson | 418/221 |
| 1,565,133 | 12/1925 | Williams | 418/248 |
| 1,581,148 | 4/1926 | Williams | 418/248 |
| 1,626,855 | 5/1927 | Mepstead | 418/248 |
| 2,515,288 | 7/1950 | Barrett | 418/248 |
| 3,276,386 | 10/1966 | Fanshawe | 418/248 |

FOREIGN PATENT DOCUMENTS

| | | | |
|---|---|---|---|
| 922,121 | 3/1963 | United Kingdom | 418/248 |

*Primary Examiner*—John J. Vrablik
*Attorney, Agent, or Firm*—M. Ted Raptes

[57] ABSTRACT

The invention relates to a rotary steam engine comprising a peripheral, circular casing with side walls defining an interior cylindrical section wherein a rotor is adapted to rotate therein. The rotor comprises a series of spaced transverse lobes with spring-biased transverse seals at the outer circular periphery thereof, which are adapted to engage the inner circular periphery of the casing. The casing comprises a series of spaced spring-biased transverse vanes adapted to engage the outer periphery, seals and lobes of the rotor. A series of chambers are defined by the seals and lobes, outer periphery of the rotor, the inner periphery of the casing and the side walls. A series of steam inlets and exhaust steam outlets pairs communicate with said chambers as the rotor is rotated by expansion of live steam against the vanes in said chambers.

2 Claims, 2 Drawing Figures

ROTARY MOTOR

CROSS REFERENCE TO RELATED APPLICATION

This is a continuation, of application Ser. No. 419,284, filed Nov. 27, 1973, now abandoned.

This application is a continuation-in-part of my copending application Serial No. 348,126 filed April 5, 1973.

BACKGROUND OF THE INVENTION

This invention relates to improvements in rotary fluid motors operable with an expansible fluid such as steam, freon and the like. With the present problems of pollution of the atmosphere by exhausts of conventional gasoline combustion engines, considerable attention is being given to the development of engines which are virtually smogless with no polluting exhaust into the atmosphere from the engine proper.

Steam engines are well known and provide a smogless type of exhaust. However, such engines are usually quite complicated and to date have failed to provide a suitable replacement for gasoline combustion engines.

BRIEF SUMMARY OF THE INVENTION

An object of the invention is to construct a rotary steam engine of a simplified and novel design, whereby the engine can operate in either rotary direction and can be easily reversed in operation.

Another object of the invention is to provide a novel arrangement of a reversing steam distribution valve and steam lines, whereby the steam can be introduced into the engine through steam lines which can operate as live steam inlets or exhaust steam outlets depending on the desired direction of rotation of the rotor of the engine.

A further object is to provide a rotary steam engine which is smooth and silent with no polluting exhaust to the atmosphere.

A further object of the invention is to provide novel vane or gate means adapted to ride on the outer periphery of the rotor of the engine and which cooperate with lobes and seals on the rotor to define a series of chambers which provide rotary motion to the rotor by introduction of live steam therein against the vanes, and also providing means to remove exhaust steam by the sweeping action of the vanes.

DETAILED DESCRIPTION OF THE INVENTION

Figure 1:
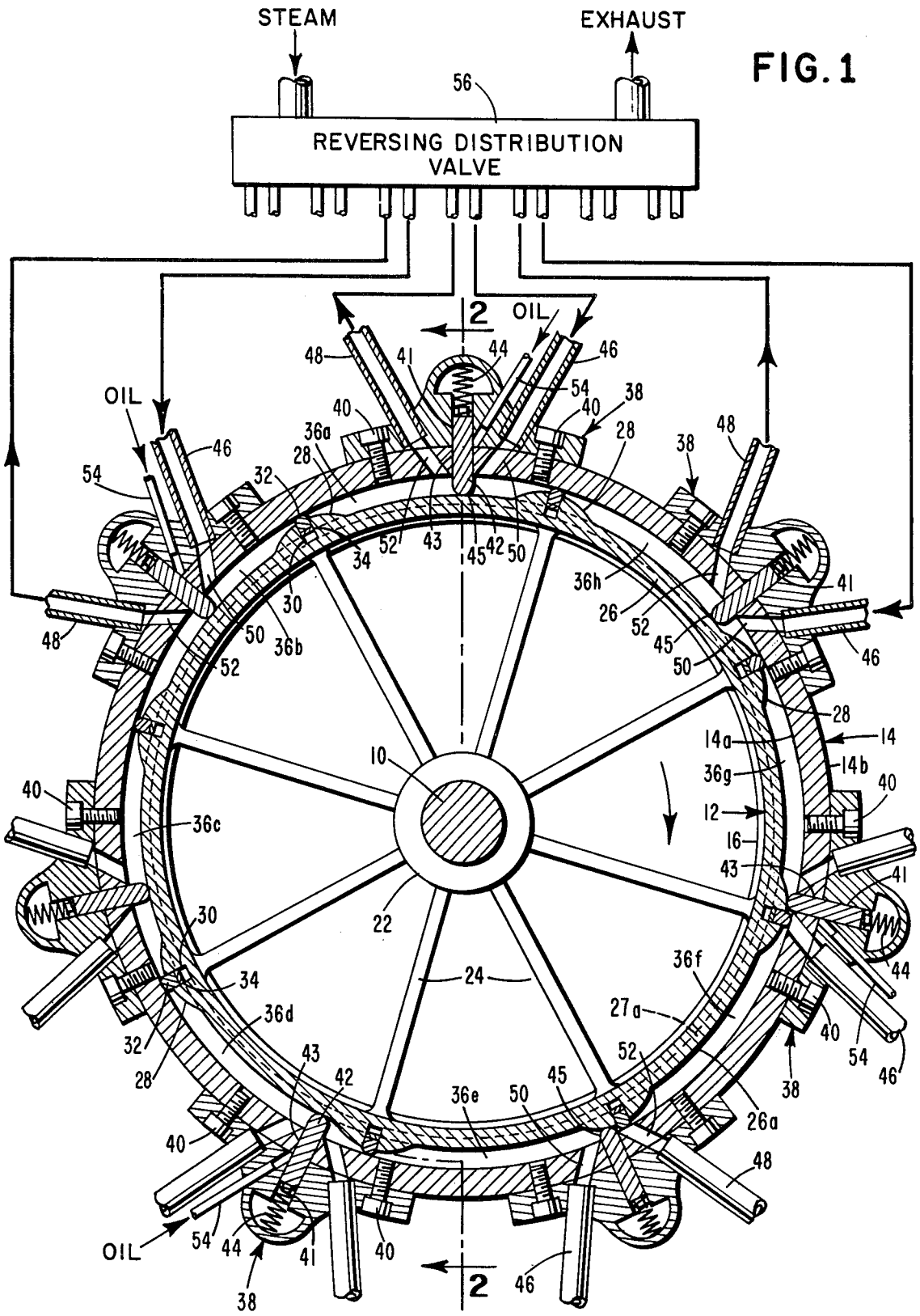
Figure 2:
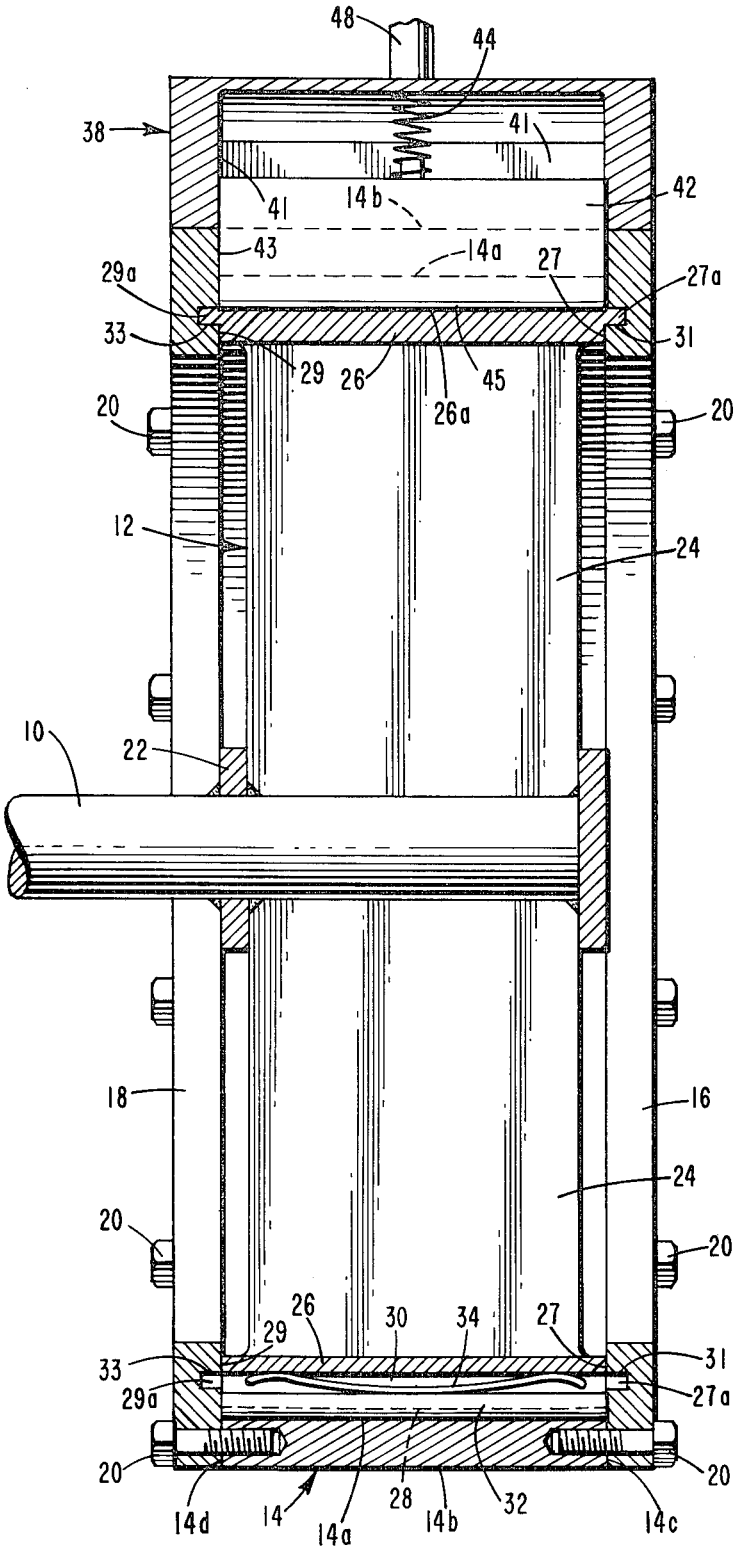

The above objects, features, and advantages of the invention will be more apparent by reference to the following specification and accompanying drawings in which:

FIG. 1 is a vertical cross-sectional view of a rotary motor design characterized by the features of this invention; and FIG. 2 is a cross-sectional view of the motor taken substantially along line 2—2 of FIG. 1.

Referring more particularly to the drawings, 10 indicates a concentrically arranged shaft upon which a rotor indicated generally by numeral 12 is keyed by suitable conventional means. The rotor is disposed within a circular casing 14 and annular side plates 16 and 18 as shown in FIG. 2. The side plates 16 and 18 are bolted onto the side peripheries 14*c* and 14*d*, respectively, of the casing by bolts 20. Shaft 10 is rotatably journaled in suitable roller bearings (not shown) mounted on suitable (not shown) adjacent side plate 18.

The rotor 12 comprises a hub 22, radial spokes 24, and a circular rim 26. The outer periphery 26*a* of rim 26 is spaced from the inner periphery 14*a* of casing 14. Extending from the outer periphery of rim 26 is a series of spaced transverse lobes 28 extending from side wall to side wall. At the peak of each lobe there is provided a transverse slot 30 extending from side wall to side wall and containing a removable transverse seal 32 and spring 34. The seals extend from side wall to side wall within the slot and are adapted to be movable and to be pressed firmly by the springs against the inner periphery 14*a* of casing 14. Because the slot extends across the lobe and is open at the contact with the side walls, replacement of the springs and seals is simple, it being only necessary to remove either side wall instead of dismantling the entire motor. A series of chambers or compartments 36 (a through h) are formed between adjacent seals 32, outer periphery 26*a* of rim 26, inner periphery 14*a* of casing 14 and side walls 16 and 18.

Casing 14 has a series of spaced vane or gate guide members generally indicated at 38 mounted on the outer periphery 14*b* thereof by suitable means such as bolts 40. Guide members 38 comprise a transverse slot 41 aligned with transverse slot 43 in casing 14, containing a transverse vane or guide 42 biased against a compression spring 44. Vanes 42 have rounded convex ends 45 in order that they can easily ride over the lobes 28 and seals 32 on the rotor. Vances 42 also extend from side wall to side wall. Guide members 38 also comprise steam inlet lines 46 and steam exhaust lines 48 aligned with respective ports 50 and 52 through the casing 14. Oil inlet lines 54 in member 38 lead to slot 41 and slot 43 and provide lubrication for vanes 42 and the inner periphery 14*a* of casing 14 over which seals 32 ride. As many as four oil inlets spaced around the casing are adequate for lubrication. The intake and exhaust lines are suitably connected to a reversing distribution valve system or maniford 56.

It is to be noted that the steam intake ports 50 and steam exhaust ports 52 must be as close as possible on either side of the vanes 42. This will prevent vacuum or compression adjacent the vanes.

Rotor 12 also comprises two peripheral wall members 27 and 29 on both sides of and integral with rim 26 having respective circumferential flanges 27*a* and 29*a* adapted to fit into respective circumferential grooves 31 and 33 of side walls 16 and 18 respectively. The flanges 27*a* and 29*a* extend laterally from and the tops of the flanges are flush with the outer periphery 26*a* of rim 26. Accordingly, the flanges extend from the base of the lobe 28. The purpose of the flanges is to prevent leakage of steam between the side walls 16 and 18 and sides 27 and 29 of rim 26.

The motor can operate in either direction whereby the intake and exhaust lines can be suitably reversed by the distribution valve 56. When operating in a clockwise direction as shown in FIG. 1 of the drawings, live steam or other expansive fluid enters, for example, chamber 36*a* through intake line 46 and port 50 and will expand between vane 42 and the seal of lobe 28 (between chambers 36*a* and 36*h*) thereby forcing the rotor in a clockwise direction. Similarly, steam is entering chambers 36*b*, 36*c*, 36*d*, 36*e*, 36*f*, and 36*h* thereby imparting clockwise rotary motion to the rotor. Note that chamber 36*g* is not receiving steam momentarily and no rotary motion is imparted therein. However, as soon as the seal 32 on lobe 28 passes the steam inlet 46, chamber 36g will again receive steam providing rotary motion. This is only a momentary idleness on the part of chamber 36g and similarly there is idleness in the other chambers. It can be seen that the maximum amount of force present at any one moment in each chamber is staggered. The staggering provides a uniform rotary motion to the rotor and prevents a surges in rotary motion, which would be the case if all chambers were to receive the full force of the steam expansion at the same moment.

Concurrently as the steam is entering each chamber, exhausted steam is being removed from each chamber through exhaust ports 52 and exhaust lines 48 by the sweeping action of vanes 42. It will be apparent from the above operation that live steam is continuously being introduced and imparting an impulse to the rotor in each chamber except 36g as explained above, while at the same time exhausted steam is being continuously removed from each chamber.

The engine as described above is operable on steam, freon and the like and the exhaust is virtually pollution-free. The only fumes produced, which are negligible, are those from a burner required for heating water to produce steam for the engine. The engine is silent and turns smoothly with no vibration. The size of the engine can vary, depending on power required, i.e., a 32 inch diameter engine will contain 32 chambers and 31 vanes. Thus, the power of the engine can be increased by increasing the diameter of the engine thereby providing more chambers, or by increasing the capacity of the chambers of the rotor or by increasing the steam pressure.

The seals 32 and vanes 42 are replaceable as they wear out and are made of a suitable material which does not cause wear on the rotor and casing surfaces.

What is claimed is:

1. A rotary engine capable of being driven by a fluid such as steam and the like comprising a peripheral cylindrical casing, a rotor having a circular peripheral rim spaced from the inner periphery of said casing and adapted to rotate within said casing, and a pair of side walls disposed between said casing and said rim thereby defining an annular enclosed space:

a. said rotor comprising on the outer periphery of said rim a plurality of equally spaced transverse lobes, each lobe containing a transverse slot at its peak and transverse spring-biased seal means disposed within said slot adapted to engage the inner periphery of said casing, said lobe, slot and seal means extending between and to said side walls;

b. a plurality of equally spaced, vane guide members disposed on the outer periphery of said casing, each guide member containing a transverse slot aligned with a transverse slot in said casing, a spring-biased transverse vane means comprising rounded convex ends disposed within said guide member transverse slot means and said casing transverse slot means, said vane means convex ends adapted to engage the outer periphery of said rim and said lobes, said vane means and slot means extending between and to said side walls;

c. each of said vane guide members comprising a fluid inlet and a fluid exhaust means adapted to be aligned with respective inlet and exhaust port means in said casing, said inlet port means adapted to be disposed on one side and said exhaust port means disposed on the other side and in close proximity to said casing slot means;

d. said fluid inlet and fluid exhaust means communicating with manifold means for introducing live fluid and exhausting exhausted fluid;

e. said rotor containing at least eight total number of lobes and said casing containing one less total number of vanes than the total number of lobes;

f. said rim comprising peripheral transverse flange means extending on each said from the outer peripheral surface of said rim and adapted to fit and turn within respective circumferential grooves contained in said side walls;

g. oil inlet means disposed through said vane guide members communicating with one side of said vane and said casing slot means; whereby adjacent lobes and respective seals, the inner periphery of said casing, and the outer periphery of said rim define the same number of individual chambers in said annular enclosed space as there are number of lobes, wherein during rotation of said rotor each chamber is adapted to communicate with succeeding vane means and respective fluid inlet and exhaust port means; and wherein expansion of continuously introduced live fluid into said chambers from said inlet ports against said vane means imparts rotary motion to said rotor, and simultaneously exhausted fluid is continuously removed from said chambers through said exhaust ports by the sweeping action of said vane means, and wherein during rotation the maximum amount of force obtained by expansion of introduced fluid in each successive chamber is progressively staggered to impart uniform rotary motion to said rotor.

2. The rotory engine of claim 1, wherein said manifold means comprises reversing means whereby said engine can operate clockwise or counterclockwise.

* * * * *